US007484489B2

(12) United States Patent
Hong

(10) Patent No.: US 7,484,489 B2
(45) Date of Patent: Feb. 3, 2009

(54) DUAL OIL FEED STRUCTURE OF CYLINDER DE-ACTIVATION ENGINE FOR VEHICLE

(75) Inventor: Soon Il Hong, Gyeonggi-do (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 11/601,220

(22) Filed: Nov. 17, 2006

(65) Prior Publication Data

US 2008/0047510 A1 Feb. 28, 2008

(30) Foreign Application Priority Data

Aug. 23, 2006 (KR) ..... 10-2006-0080090

(51) Int. Cl.
*F01L 1/14* (2006.01)

(52) U.S. Cl. ..... 123/90.59; 123/90.16; 123/90.48

(58) Field of Classification Search ..... 123/90.59, 123/90.16, 90.48
See application file for complete search history.

(56) References Cited

U.S. PATENT DOCUMENTS

| | | | | |
|---|---|---|---|---|
| 4,858,574 | A * | 8/1989 | Fukuo et al. | 123/90.34 |
| 6,557,518 | B1 | 5/2003 | Albertson et al. | |
| 6,584,942 | B1 | 7/2003 | Albertson et al. | |
| 6,681,734 | B2 | 1/2004 | Albertson | |
| 2003/0089322 | A1 * | 5/2003 | Dinkel et al. | 123/90.13 |
| 2005/0019397 | A1 | 1/2005 | Jacobs | |
| 2006/0102119 | A1 * | 5/2006 | Gecim et al. | 123/90.16 |

FOREIGN PATENT DOCUMENTS

| | | | |
|---|---|---|---|
| EP | 1 571 300 | A2 | 9/2005 |
| KR | 10-2004-0031578 | A | 4/2004 |

* cited by examiner

*Primary Examiner*—Zelalem Eshete
(74) *Attorney, Agent, or Firm*—Peter F. Corless; Kongsik Kim; Edwards Angell Palmer & Dodge LLP

(57) ABSTRACT

Disclosed is a dual oil feed structure of a cylinder de-activation engine for a vehicle, comprising: (a) a main oil hole supplying oil to a hydraulic lash adjuster to adjust a valve gap; and (b) a sub oil hole supplying oil to a roller finger follower which operates the cylinder de-activation device.

7 Claims, 4 Drawing Sheets

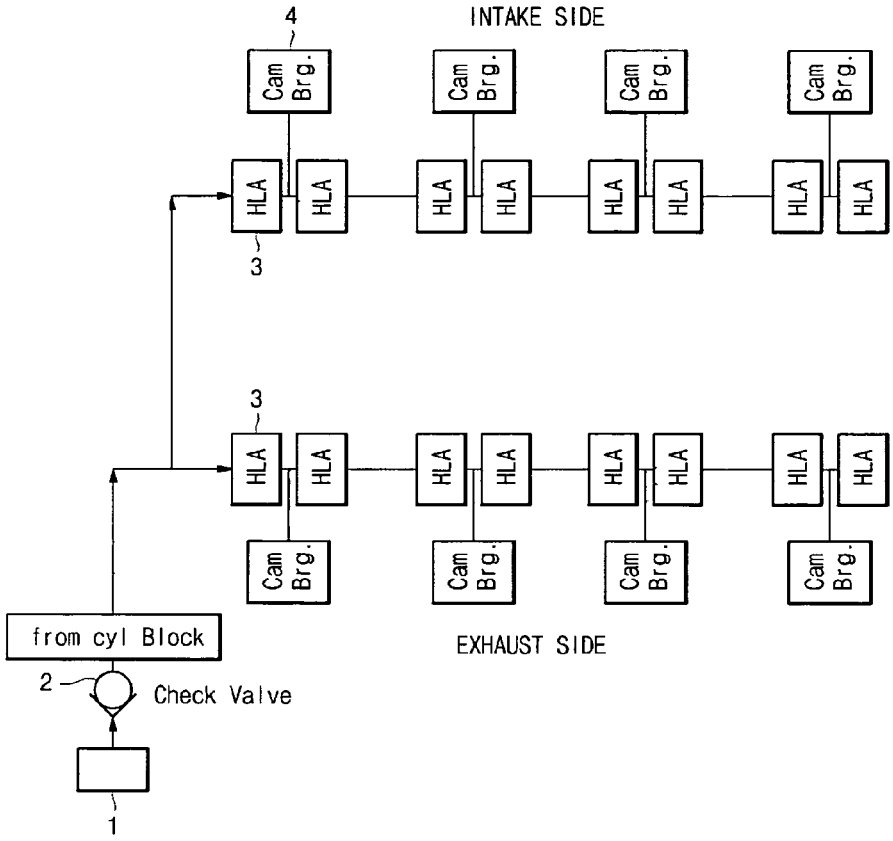
【Fig. 1】

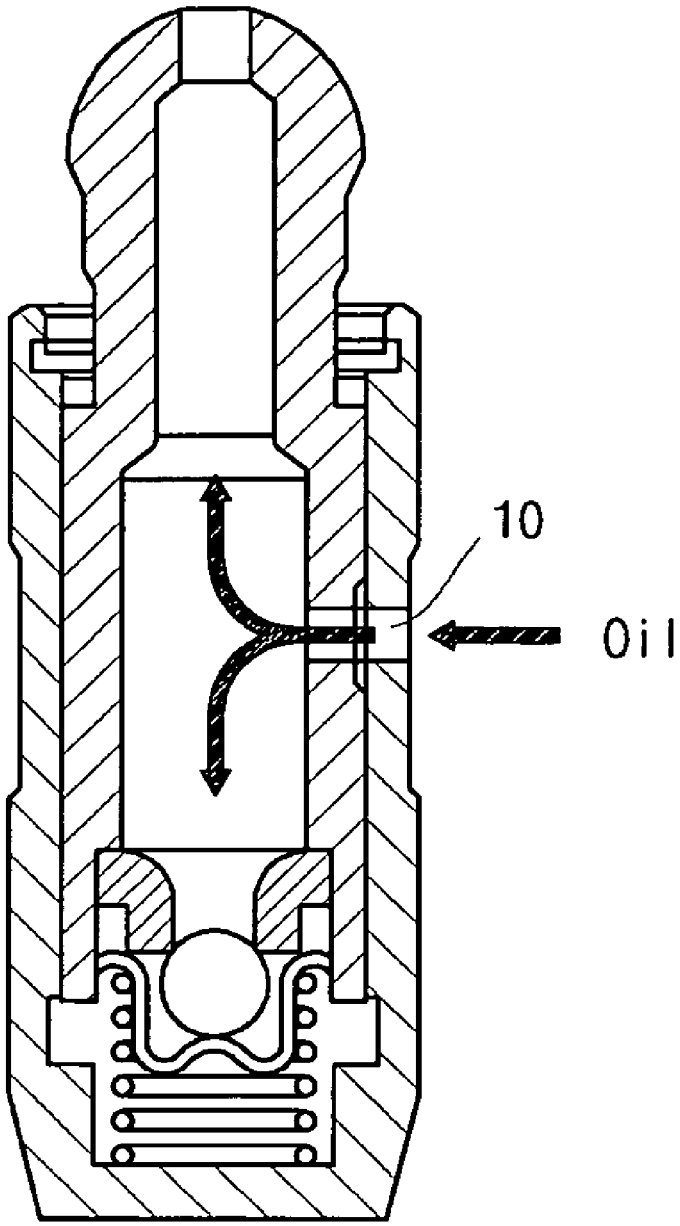
【Fig. 2】

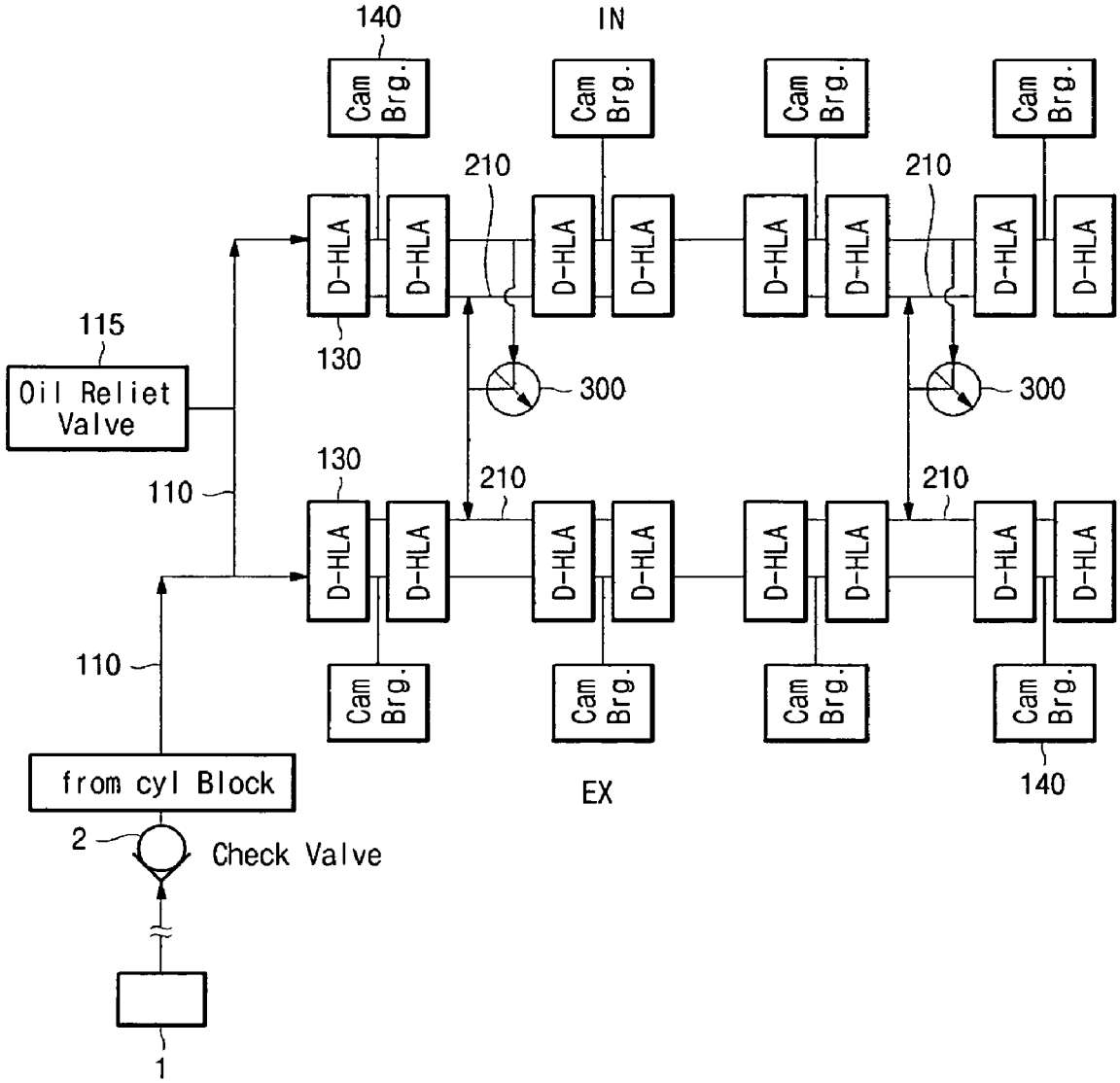
【Fig. 3】

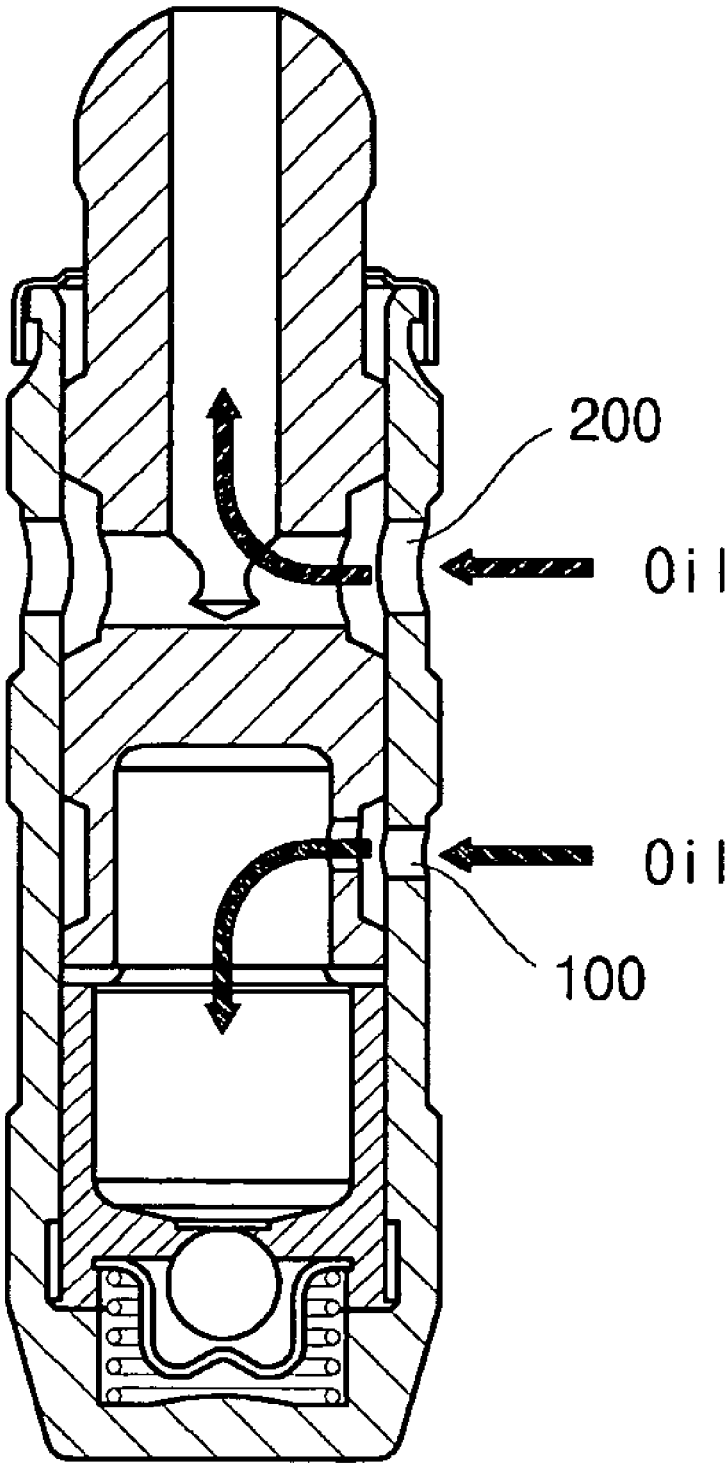
【Fig. 4】

DUAL OIL FEED STRUCTURE OF CYLINDER DE-ACTIVATION ENGINE FOR VEHICLE

CROSS-REFERENCE TO RELATED APPLICATION

This application claims priority to and the benefit of Korean Patent Application No. 10-2006-0080090 filed in the Korean Intellectual Property Office on Aug. 23, 2006, the entire contents of which are incorporated herein by reference.

BACKGROUND OF THE INVENTION (a) Field of the Invention

The present invention relates to a dual oil feed structure having two oil holes for use in a cylinder de-activation engine for a vehicle.

(b) Description

In a conventional cylinder head of an internal combustion engine having a stationary valve lift mechanism, operation of an oil pump rotor driven by a crankshaft forms oil pressure, which in turn supplies oil to a cylinder head through a cylinder block.

FIG. 1 shows oil circuits of a conventional cylinder head of an engine having a stationary valve lift mechanism.

Referring to FIG. 1, oil pressurized by an oil pump is delivered through an oil gallery 1 of a cylinder block, thereby lubricating a crankshaft bearing and a connecting rod bearing part, and is then transferred to a cylinder head via a non-return valve which is called a check valve 2.

Thereafter, the oil transferred to the cylinder head is supplied to a hydraulic lash adjuster (HLA) 3, and at the same time is supplied to a camshaft bearing part 4.

The hydraulic lash adjuster as shown in FIG. 2 is provided with one oil hole 10 for supplying oil.

A conventional lubrication structure of a cylinder head as described above is generally applied to an engine provided with a mechanical lash adjuster (MLA) as well as an engine provided with an HLA.

However, such conventional oil circuit structure having one oil hole can be applied to a cylinder head with a stationary valve lift mechanism, but it cannot be applied to a cylinder de-activation device which adjusts a valve lift to zero position during the operation of the engine so as to stop operation of a valve, thereby deactivating operation of a cylinder.

In order to operate the cylinder de-activation device, oil circuit of the cylinder head should adequately supply or cut oil in response to the degree of necessity. Conventional oil feed structures, however, cannot satisfy such requirements, thereby not being able to stably operate the cylinder de-activation device.

There is thus a need for an improved dual oil feed structure that can satisfy the requirements so as to stably supply oil to a cylinder de-activation device.

The information disclosed in this Background of the Invention section is only for enhancement of understanding of the background of the invention and should not be taken as an acknowledgement or any form of suggestion that this information forms the prior art that is already known to a person skilled in the art.

SUMMARY OF THE INVENTION

In one aspect, a dual oil feed structure of a cylinder de-activation engine for a vehicle is provided, which comprises: (a) a main oil hole supplying oil to a hydraulic lash adjuster to adjust a valve gap; and (b) a sub oil hole supplying oil to a roller finger follower which operates the cylinder de-activation device.

In another aspect, vehicle engines comprising the dual oil feed structure described above and motor vehicles comprising such engines are provided.

Other aspects of the invention are discussed infra.

BRIEF DESCRIPTION OF THE DRAWINGS

FIG. 1 is a schematic diagram of a conventional oil circuit of a cylinder head of a vehicle.

FIG. 2 is a cross sectional view showing a conventional hydraulic lash adjuster.

FIG. 3 is a schematic diagram of a dual oil feed structure of a cylinder de-activation engine according to an exemplary embodiment of the present invention.

FIG. 4 is a cross sectional view showing a hydraulic type vale gap regulating device of a dual oil feed structure according to an exemplary embodiment of the present invention.

Reference numerals set forth in the Drawings includes reference to the following elements as further discussed below:

1: oil gallery
2: check valve
100: main oil hole
110: main oil passage
115: oil relief valve
130: hydraulic lash adjuster
140: camshaft bearing part
200: sub oil hole
210: sub oil passage
300: oil control valve

DETAILED DESCRIPTION

As discussed above, the present invention provides a dual oil feed structure of a cylinder de-activation engine for a vehicle, comprising: (a) a main oil hole supplying oil to a hydraulic lash adjuster to adjust a valve gap; and (b) a sub oil hole supplying oil to a roller finger follower which operates the cylinder de-activation device.

Preferably, mail oil hole may be connected to a main oil passage in which oil flows through the main oil hole. Also preferably, sub oil hole may be connected to a sub oil passage in which oil flows through the sub oil hole.

Suitably, sub oil passage may be configured to be in communication with main oil passage.

In a preferred embodiment of the present invention, a dual oil feed structure may further comprise an oil relief valve in an inlet portion of the main oil passage to prevent an excessive increase in oil pressure.

In another preferred embodiment of the present invention, a dual oil feed structure may further comprise a plurality of oil control valves, each of which controls the main oil hole and the sub oil hole respectively.

In such dual oil feed structure, oil control valve may suitably control oil flow in the air intake part and exhaust part of the engine simultaneously.

In another aspect, the present invention provides a vehicle engine comprising the dual oil feed structure described above. A motor vehicle comprising such engine is also provided. It is understood that the term "vehicle" or other similar term as used herein is inclusive of motor vehicles in general such as passenger automobiles, buses, trucks, various commercial vehicles, and the like.

Reference will now be made in detail to the preferred embodiment of the present invention, examples of which are illustrated in the drawings attached hereinafter, wherein like reference numerals refer to like elements throughout. The embodiments are described below so as to explain the present invention by referring to the figures.

FIG. 3 is a schematic diagram of a dual oil feed structure of a cylinder de-activation engine according to a preferred embodiment of the present invention, and FIG. 4 is a cross sectional view showing a hydraulic type vale gap regulating device of a dual oil feed structure according to a preferred embodiment of the present invention.

Referring to FIG. 3 and FIG. 4, a dual oil feed structure of a cylinder de-activation engine according to an exemplary embodiment of the present invention will be explained hereinafter.

Preferably, as shown in FIG. 3, oil supplied from a cylinder block can be supplied to a main oil passage 110 and a sub oil passage 210 separately.

An oil control valve 300 may be disposed at a center portion of the main oil passage 110, thereby supplying oil to the sub oil passage 210.

Oil within the main oil passage 110 is supplied to a hydraulic valve gap adjuster (hereinafter referred to as a hydraulic lash adjuster) 130 so as to adjust a valve gap as zero, and oil is supplied to a camshaft bearing 140.

Also preferably, a plurality of oil control valves 300 may be disposed between a main oil passage 110 and a sub oil passage 210. The control valve may suitably supply oil at a specific pressure even when it does not operate, thereby lubricating the hydraulic lash adjuster 130, and RFF (roller finger follower) (not shown), and a cam.

In case where the oil control valve 300 is in ON state, oil of the main oil passage 110 may be connected to the sub oil passage 210, so that oil at a high pressure can be sent to the RFF for a cylinder de-activation device via the hydraulic lash adjuster 130, thereby operating the cylinder de-activation device.

As discussed above, unlike conventional hydraulic lash adjusters, preferred oil circuit of the present invention employs the hydraulic lash adjuster 130 having a dual oil feed structure.

As shown in FIG. 4, a preferred hydraulic lash adjuster having a dual oil feed structure comprises a main oil hole 100 and a sub oil hole 200, while conventional hydraulic lash adjusters comprise, as shown in FIG. 2), only one oil hole through which oil is supplied to adjust a valve gap.

Accordingly, the main oil hole 100 serves to supply oil to the hydraulic lash adjuster for the adjustment of a valve gap, and the sub oil hole 200 serves to supply oil to the RFF which is an operating apparatus of a cylinder de-activation device.

Suitably, the two oil holes 100 and 200 may be controlled by respective oil control valves thereof.

Meanwhile, as described above, the sub oil passage 210 supplying oil to the sub oil hole 200 may be in communication with the main oil passage 110 allowing oil to flow to the main oil hole 100.

Accordingly, oil may be supplied to the sub oil passage 210 through the oil control valve 300 installed in the main oil passage 110.

In addition, the oil control valve 300 may supply oil to both an intake part and an exhaust part, thereby simultaneously controlling the intake part and the exhaust part.

Suitably, oil passage may be designed so that two oil control valves 300 are provided in a center portion of the sub oil passage 210 of the oil circuit structure to ensure that cylinders can be independently controlled.

Meanwhile, in order to prevent the cylinder de-activation device from malfunctioning due to an excessive increase of oil pressure generated in the main oil passage 110, an oil relief valve 115 may suitably be installed in an inlet portion of the main oil passage 110.

Operation of a dual oil feed structure of a cylinder de-activation engine for a vehicle according to an embodiment of the present invention will be explained hereinafter.

Oil pressurized by an oil pump is delivered through an oil gallery 1 of a cylinder block to lubricate a crankshaft bearing (not shown) and a connecting rod bearing part (not shown), and is then transferred to a cylinder head via a non-return valve which is called a check valve 2.

Thereafter, the oil transferred to the cylinder head is supplied to HLA 130 through the main oil passage 110, and at the same time is supplied to a camshaft bearing 140.

In addition, the oil control valve 300 installed in the main oil passage 110 is controlled such that oil may flow into the sub oil passage 210 which supplies oil to the RFF for operating the cylinder de-activation device.

As such, oil for lubricating the cylinder de-activation device and the cam bearing can be independently drawn out, so that desirable operability of the cylinder de-activation can be attained and the cam bearing can be stably lubricated, thereby enhancing the performance of a cylinder de-activation device, and improving the fuel mileage thereof.

The invention has been described in detail with reference to preferred embodiments thereof. However, it will be appreciated by those skilled in the art that changes may be made in these embodiments without departing from the principles and spirit of the invention, the scope of which is defined in the appended claims and their equivalents.

What is claimed is:

1. A dual oil feed structure of a cylinder de-activation engine for a vehicle, comprising:

(a) a main oil hole supplying oil to a hydraulic lash adjuster to adjust a valve gap, wherein the main oil hole is connected to a mail oil passage in which oil flows through the main oil hole; and (b) sub oil hole supplying oil to a roller finger follower which operates the cylinder de-activation device, wherein (i) the sub oil hole is connected to a sub oil passage in which oil flows through the sub oil hole, (ii) the sub oil passage is configured to be in communication with the main oil passage, and (iii) oil is supplied to the sub oil passage through an oil control value installed in the main passage, wherein oil is supplied to the roller finger follower via the hydraulic lash adjuster.

2. The dual oil feed structure of claim 1, further comprising an oil relief valve in an inlet portion of the main oil passage to prevent an excessive increase in oil pressure.

3. The dual oil feed structure of claim 1, further comprising a plurality of oil control valves, each of which controls the main oil hole and the sub oil hole respectively.

4. The dual oil feed structure of claim 3, wherein the oil control valve controls oil flow in the air intake part and exhaust part of the engine simultaneously.

5. A vehicle engine comprising the dual oil feed structure of claim 1.

6. A motor vehicle comprising the engine of claim 5.

7. The dual oil feed structure of claim 1, wherein oil at a specific pressure is supplied to the roller finger follower for lubrication thereof via the oil control valve, even when the oil control valve does not operate.

* * * * *